US009440277B2

(12) United States Patent
Binder

(10) Patent No.: US 9,440,277 B2
(45) Date of Patent: Sep. 13, 2016

(54) FOLLOW-ON AND/OR TRANSFER METHOD FOR PRODUCING STRIPS

(75) Inventor: Heinz Binder, Weidenstetten (DE)

(73) Assignee: Gebruder Binder GMBH, Neenstetten (DE)

( * ) Notice: Subject to any disclaimer, the term of this patent is extended or adjusted under 35 U.S.C. 154(b) by 834 days.

(21) Appl. No.: 13/527,766

(22) Filed: Jun. 20, 2012

(65) Prior Publication Data

US 2012/0318032 A1 Dec. 20, 2012

(30) Foreign Application Priority Data

Jun. 20, 2011 (DE) ..... 10 2011 104 830
Jun. 20, 2011 (DE) ..... 10 2011 105 030

(51) Int. Cl.
*B21D 35/00* (2006.01)
*B21D 22/02* (2006.01)
*B21D 28/06* (2006.01)

(52) U.S. Cl.
CPC ..... *B21D 35/001* (2013.01); *B21D 22/02* (2013.01); *B21D 28/06* (2013.01)

(58) Field of Classification Search
CPC .... B21D 28/06; B21D 22/02; B21D 35/001; B21D 5/08; B21D 5/14; B21D 53/26; B21D 53/88; B21D 28/10; B21D 28/26; B21D 28/32; B21D 22/08; B21D 21/00; B21D 35/00
USPC ..... 72/176–182, 324, 404, 405.01
See application file for complete search history.

(56) References Cited

U.S. PATENT DOCUMENTS 3,650,141 A * 3/1972 Pepe ..... 72/332
4,333,221 A * 6/1982 Hayashi ..... 29/413
4,487,053 A * 12/1984 Bauer et al. ..... 72/335
4,543,811 A * 10/1985 Aoyama ..... 72/332
4,676,090 A * 6/1987 Nishimura et al. ..... 72/404
5,182,933 A * 2/1993 Schick ..... 72/335
5,542,775 A * 8/1996 Bechtoldt et al. ..... 403/188
5,862,579 A * 1/1999 Blumberg ..... 29/417
6,087,639 A * 7/2000 Engelke et al. ..... 219/542
2001/0052255 A1* 12/2001 Arai ..... 72/379.2
2003/0115926 A1* 6/2003 Cutshall et al. ..... 72/404
2009/0012364 A1* 1/2009 Kitagawa et al. ..... 600/141
2013/0255346 A1* 10/2013 Danby et al. ..... 72/352

FOREIGN PATENT DOCUMENTS

DE 2 302 390 7/1973
DE 197 49 902 5/1999

(Continued)

OTHER PUBLICATIONS

Espacenet Translation of EP2145707A2.*

(Continued)

*Primary Examiner* — Shelley Self
*Assistant Examiner* — Peter Iannuzzi
(74) *Attorney, Agent, or Firm* — Seager, Tufte & Wickhem LLP

(57) ABSTRACT

In a first aspect, a method for producing a strip from a web material using a follow-on and/or transfer method, wherein the strip to be produced has a first length of 20 cm or more in the longitudinal direction and has a U-shaped cross section, wherein the U-shaped cross section has an opening width of 6 mm or less and extends in the longitudinal direction in a first curvature and a second curvature, wherein the center point of the first curvature lies to the side of a limb of the U-shaped cross section and the center point of the second curvature lies above or below an opening in the U-shaped cross section.

11 Claims, 13 Drawing Sheets

(56) References Cited

FOREIGN PATENT DOCUMENTS

| | | | | |
|---|---|---|---|---|
| DE | 201 02 056 | | 6/2001 | |
| DE | 10 2004 051 454 | | 4/2006 | |
| DE | 10 2005 046 843 | | 4/2007 | |
| DE | 20 2007 002 727 | | 7/2007 | |
| DE | 10 2009 008 356 | | 8/2010 | |
| EP | 2145707 | A2 * | 1/2010 | ..... B21D 53/00 |
| WO | WO 2011028196 | A2 * | 3/2011 | |

OTHER PUBLICATIONS

Magazin Engelinside: Produktionsprozess Walzprofilieren im Detail. Jan. 2011—ISBN keine with translation.

Michael Pyper, Tu Darmstadt: Walzprofilieren stark im Kommen—Neue Verfahren und höherfeste Werkstoffe erschieβen. Blech Jan. 2007—ISBN keine with translation.

Engel und Selter Poteniale und Fertigungstrategien zur goemetrichen Gastaltung von Profilbauteiten, III/2011. Verlag Meisenback GmbH, Franz-Ludwig-Straβe 7a, 96047 Bamberg: Verlag Meisenbach GmbH., 2011—1-30 ISBN keine with translation.

German Patent Office—Office Action dated May 25, 2012 in copending priority Application Serial No. 102011104830.1 with translation.

German Patent Office—Office Action dated May 29, 2012 in copending priority Application Serial No. 102011105030.6 with translation.

* cited by examiner

SECTION A-A

SECTION B-B

SECTION C-C

SECTION D-D

SECTION C-C

SECTION D-D

FOLLOW-ON AND/OR TRANSFER METHOD FOR PRODUCING STRIPS

Pursuant to 35 U.S.C. §119, the priority of Germany Patent Application Serial No. 102011104830.1, filed Jun. 20, 2011, and Germany Patent Application Serial No. 102011105030.6, filed Jun. 20, 2011, is claimed.

TECHNICAL FIELD

This description relates to a method for producing a strip from a web material using a follow-on and/or transfer method.

BACKGROUND

In current car manufacturing, the individual design of the vehicles plays an important role. As a result, parts having complex three-dimensional shapes are increasingly required. At the same time, the pressure on costs is high, and therefore efficient and cost-effective production methods are required for complex parts of this type.

One example of parts of this type are clamping strips which are used for receiving combined rubber/plastics elements (2 component elements) for sealing the gap between window panes and side frames of a vehicle body (see FIGS. 4*a* and 4*b*). Said strips may have a U-shaped cross section, typically with an opening width of 6 mm or less. Furthermore, said strips may be curved along the length thereof in different planes and may have structures for applying the clamping force and for fastening to the side frame. In order to ensure satisfactory functionality of said strips, the features just mentioned have to be produced with a high degree of accuracy in thin sheets. Difficulties are caused here in particular by the combination of a profile having a relatively narrow opening width with the three-dimensional curvature, and by the introduction of the clamping structures which further reduce the clear width of the profile (for example to 3 mm or less). In addition, elements for fastening the strip to a side frame of a car also have to be introduced into the complex part with sufficient precision.

Clamping strips of the type described above are currently manufactured by a combination of a rolling and bending method 8 and a stretching and bending method 9. In a first rolling and bending method step (see FIGS. 1*a* and 1*b*), a starting material 7 is deformed into a profile with a desired cross section by using consecutively arranged pairs of shaping rollers 1*a*, 1*b* to 6*a*, 6*b* (see FIG. 1*b*). In this case, the desired target shape is produced successively via a plurality of intermediate shapes by bending from a starting material in the form of a band. In the example illustrated in FIG. 1*b*, a U-shaped profile is manufactured using six consecutively arranged pairs of shaping rollers 1*a*, 1*b* to 6*a*, 6*b*. The profile 14 produced in this manner is then provided with the desired three-dimensional curvature in a subsequent stretching and bending step 9. As shown in FIG. 1*c*, the ends of the profile 14 are clamped for this purpose with the aid of holding devices 13. The workpiece 14 is then bent about a bending mould 12, 16, 17, 18 with the aid of suitable actuators 11, 12. The workpiece 14 can therefore be provided with a desired curvature. Additional features of the clamping strip, such as clamping cams or recesses and perforations for fastening the strip are customarily introduced into the bent profile following the stretching and bending step.

SUMMARY

In a first aspect, a method for producing a strip from a web material using a follow-on and/or transfer method, wherein the strip to be produced has a first length of 20 cm or more in the longitudinal direction and has a U-shaped cross section, wherein the U-shaped cross section has an opening width of 6 mm or less and extends in the longitudinal direction in a first curvature and a second curvature, wherein the centre point of the first curvature lies to the side of a limb of the U-shaped cross section and the centre point of the second curvature lies above or below an opening in the U-shaped cross section, comprises the following steps: partially or completely cutting free or punching out a blank from the web material, embossing or deforming the blank in one or more steps so that the first curvature is formed, embossing or deforming the blank in one or more steps so that the second curvature is formed, and embossing or deforming the blank in one or more steps so that the U-shaped cross section is formed.

The resulting shape of the strip is therefore a three-dimensionally curved shape. The method is particularly suitable for providing three-dimensional curvatures of this type in strips. The follow-on and/or transfer method can above all enable efficient and therefore cost-effective production.

In a further aspect, a method for producing a strip from a web material using a follow-on and/or transfer method, wherein the strip to be produced has a first length in the longitudinal direction, a U-shaped cross section, and one or more projections which are arranged on one side or on both sides of the U-shaped cross section and which project into the volume which is delimited by the U-shaped cross section and the longitudinal extent of the strip, comprises the steps of partially or completely cutting free or punching out a blank from the web material, embossing or deforming the one or more projections into the blank, embossing or deforming the blank in one or more steps so that the U-shaped cross section is formed, wherein at least the final embossing or deforming step in order to form the U-shaped cross section is carried out after the embossing or deforming step in order to form the projection or the projections.

The use of a follow-on and/or transfer method permits the projections (which may serve, for example, as clamping cams) to be provided before the U-shaped cross section is formed. This is not possible if a rolling and bending method is used for forming the U-shaped cross section, since the blank here is guided between the pairs of shaping rollers and therefore may not have any projections. Provision of the projections before the final embossing or deforming step in order to form the U-shaped cross section can reduce the complexity and therefore the costs of the production process. The time at which the projections are embossed can be freely selected and therefore the projections can be provided at any favourable time. For example, the projections may be embossed at the beginning of the production process of the clamping strip by embossing or deforming the planar web material. This step may be less difficult to handle and therefore ultimately may reduce the costs in comparison to embossing the projections into a U profile which, where possible, also still has a three-dimensionally bent shape. The U-shaped cross section (and optionally first and second curvatures) may be subsequently embossed, for example, using an embossing punch and a corresponding die with recesses at the locations of the projections.

The follow-on method refers to a method in which a part which is to be processed is clocked through a series of stations of a tool. At each station, one working step of the method is carried out per clock pulse. In this manner, one part is processed at each station in each clock pulse and a finished part is produced per clock pulse. Between the clock pulses, the parts are advanced to the next station in each case. The parts are connected in each case to one or more support tapes. Said support tapes may also have features, for example perforations. The latter can serve to receive catch pins, which, before a certain machining step is carried out, engage in the perforations in order to position the support tape and the parts connected thereto. This makes it possible to increase the accuracy of positioning the parts in the machining step. After the machining step is completed, the catch pins can be withdrawn and the support tape advanced together with the parts into the next machining position. After the final working step, the parts can be separated from the support tapes.

The transfer method basically resembles the follow-on method and differs merely in that the parts which are to be processed are already separated at the beginning of the process and pass through the stations as individual parts. The advance of the parts to the next station in each case therefore cannot be carried out using a transport tape. It is possible, as described in the previous paragraph, to provide perforations in which gripping elements can engage in order to advance a part. It is also possible to combine follow-on and transfer method steps.

The term "blank" refers to the workpiece in all intermediate forms after the partial or complete cutting free or punching out of the web material. Any number of machining steps can therefore be carried out consecutively on the blank. If there is a certain sequence of machining steps of the blank, said sequence becomes clear by a corresponding attribute or from the interrelationship. For example, an embossing step which is carried out on a "bent blank" signifies that there is a certain bending step upstream. It does not follow therefrom that no further step takes place between the bending step and the subsequent embossing step; merely, the sequence of the two steps is determined. Thus, first of all a first embossing step can be carried out on the abovementioned "bent blank" and subsequently a second embossing step can be carried out on the "bent blank".

A strip customarily extends further in a first direction than in two other directions which span a three-dimensional space (for example at least ten times as wide in a first direction compared with a second direction having the next larger extent). Said direction of largest extent is referred to as the "longitudinal direction". The direction is referred to here in the coordinate system of the strip. If the strip does not have any curvatures, the coordinate system of the strip coincides with a Cartesian reference coordinate system. The longitudinal direction can be identified with a spatial direction of the Cartesian reference coordinate system. The length in the longitudinal direction therefore corresponds to a distance between the starting and end points of the strip in the Cartesian reference coordinate system. If, however, the strip extends in one or more curvatures, the longitudinal direction points in different directions of the Cartesian reference coordinate system over the length of the strip. This has the consequence that the length of the strip is greater than the distance between the starting and end points of the strip in the Cartesian reference coordinate system. However, the strips which are used, for example, in cars typically have curvatures with significantly greater average radii of curvature than the length of the strip in the longitudinal direction (for example ten times the size). Therefore, the direction in which the longitudinal direction points in the reference coordinate system only changes moderately (for example by less than 20° degrees) and the length of the strip corresponds approximately to the distance between the starting and end points of the strip in the Cartesian reference coordinate system.

The "cross section" of a strip refers to a sectional profile of the strip in a plane perpendicular to the longitudinal direction of the strip. Since the longitudinal direction is defined in the coordinate system of the strip, this also applies to said plane perpendicular to the longitudinal direction. A curvature of the strip in the longitudinal direction therefore results in said perpendicular planes not having to lie parallel in the reference coordinate system at various points along the length of the strip but rather being able to be tilted in relation to one another.

In a further aspect, the embossing or deforming of the blank so that the U-shaped cross section is formed can be carried out in two or more steps. The number of steps can be selected in accordance with the precise shape of the U-shaped cross section.

In a further aspect, the separating of the blank can be carried out directly after the step of cutting free or punching out said blank from the web material. The further steps are therefore carried out in a transfer method.

In an alternative aspect, the separating of the blank can take place after the final embossing or deforming step in order to form the U-shaped cross section. The steps of the method are therefore carried out in a follow-on method. The follow-on method permits a simple and therefore cost-efficient configuration of the advance between the various machining stations (for example using a transport tape). Since the method is a method for producing strips which customarily extend primarily in the longitudinal direction, said strips can therefore be connected at the opposite ends in the longitudinal direction to respective transport tapes.

In a further aspect, the embossing or deforming in order to form the U-shaped cross section may comprise an embossing or deforming step in which the blank is embossed or deformed beyond the desired U-shaped cross section in order to take resiliency of the blank into consideration. Said step may permit certain profiles to be provided even in greatly elastic materials.

In a further aspect, the web material can be supplied by a coil, thus permitting simple loading of the process with a web material.

In a further aspect, the method is clocked and each of the steps is carried out once in each clock pulse. In the process, it is possible for a plurality of method steps to be carried out at the same time at a method station.

In a further aspect of the method, all of the embossing or deforming steps required in order to produce the strip from the web material can be carried out using the follow-on and/or transfer method.

In a further aspect of the method, the strip may be a clamping strip.

In a further aspect, the strip can be designed in order to be fastened to a vehicle frame, wherein the vehicle is preferably a car. The method is particularly readily suitable in order cost-effectively to produce strips with a complex shape (curvatures, narrow profiles, further elements distributed over the length of the strip) in relatively large piece numbers (for example more than 10 000 pieces).

In a further aspect, the one or more deforming steps in order to form the U-shaped cross section may comprise the formation of intermediate shapes from the blank.

In a further aspect, the strip may extend in a first curvature in the longitudinal direction and the method may furthermore comprise embossing or deforming the blank in one or more steps so that the first curvature is formed. The centre point of the first curvature may lie laterally next to a limb of the U-shaped cross section.

In a further aspect, embossing or deforming in order to form the first curvature may comprise bending the blank in one or more steps and calibrating the bent blank in one or more steps. It is possible with the method to provide the curvature in the strip in a single bending step. However, it may be necessary or desirable to bring the shape of the curvature to a desired size in one or more subsequent calibrating steps. The accuracy of the method can therefore be further increased.

In a further aspect, the bending the blank can be carried out in one step and the calibrating of the bent blank in two steps.

In a further aspect, the strip can extend in a second curvature in the longitudinal direction and the method can furthermore comprise embossing or deforming of the blank in one or more steps so that the second curvature is formed. In particular, the strip can extend both in the first and in the second curvature in the longitudinal direction. The resulting shape of the strip is therefore a three-dimensionally curved shape. The method is particularly suitable for providing three-dimensional curvatures of this type in strips.

In a further aspect, the centre point of the second curvature can lie above or below an opening in the U-shaped cross section.

In a further aspect, the embossing or deforming in order to form the second curvature may comprise bending the blank in one or more steps and calibrating the bent blank in one or more steps. As also in the case of the first curvature, the embossing of the second curvature can be carried out in a single step or in one or more bending steps and in subsequent calibrating steps in order to obtain greater accuracy.

In a further aspect, the bending of the blank can take place in one step and the calibrating of the bent blank in two steps.

In a further aspect, at least one step of bending the blank in order to form the first curvature and at least one step of bending the blank in order to form the second curvature can be carried out at the same time. For example, first and second curvatures can be provided in the blank with an individual bending step.

In a further aspect, at least one step of calibrating the bent blank in order to form the first curvature and at least one step of calibrating the bent blank in order to form the second curvature can be carried out at the same time. For example, the first and second curvatures can be brought to size with an individual calibrating step.

In a further aspect, embossing or deforming the blank in order to form the U-shaped cross section may comprise bending the blank in one or more steps and calibrating the bent blank in one or more steps. In particular, the forming of a U-shaped cross section with a small opening width (for example below 6 mm) in a strip having a length of more than 20 cm can be carried out precisely with one bending step and subsequent calibrating steps.

In a further aspect, at least one step of bending the blank in order to form the U-shaped cross section and at least one step of bending the blank in order to form the first and second curvatures can be carried out at the same time. The U-shaped cross section and the first and second curvatures may also be formed in a single bending step. This is made possible by the high degree of flexibility in the design of the embossing and deforming tools in the follow-on or transfer methods. Unlike with conventional methods, complex strips can therefore also be formed in a single method step.

In a further aspect, at least one step of calibrating the blank in order to form the U-shaped cross section and at least one step of calibrating the blank in order to form the first and second curvatures can be carried out at the same time. Precisely as in the case of the bending step, the U-shaped cross section and the first and second curvatures of the strip can also be calibrated simultaneously in one method step. This permits an efficient calibration of the complex strip shape.

In a further aspect, each embossing or deforming step can contribute to forming the first and second curvatures and the U-shaped cross section.

In a further aspect, the method comprises precisely one step for simultaneously bending the first and second curvatures and the U-shaped cross section.

In a further aspect, the steps of embossing or deforming the first and second curvatures and the U-shaped cross section may comprise a substantially vertical movement of an embossing or deforming tool and the calibrating steps may comprise a substantially horizontal movement of a calibrating tool. In the calibrating steps, the machined blank can therefore be guided in a direction perpendicularly to a direction of movement of the bending tool.

In a further aspect, the calibrating steps can be carried out using a sliding process, preferably using a tapered sliding process. With the aid of the tapered slide, a deflection in the movement of a machine can be converted into a movement of a tool perpendicular thereto.

In a further aspect, one of the sides of the U-shaped cross section may have a wavy shape and the method can furthermore comprise embossing or deforming the blank in one or more steps so that the wavy shape is formed. The wavy shape together with the one or more projections can ensure that further elements can be clamped into the strips. The precision with which said features are provided in the strip is again crucial for satisfactory functioning of the strip. With the method, the wavy shape can be implemented before formation of the U-shaped cross section and, if present, the first and second curvatures. This can permit precise positioning of the wavy shape on the strip and especially relative to the projections, since the wavy shape can be provided in a substantially planar blank.

In a further aspect, the strip can further comprise at least two recesses and the method comprises cutting free or punching the recesses out of the blank. Recesses of this type may serve, for example, to receive fastening elements with which the strip can be fastened to a further structure. In numerous applications, it is important for the strip to be fastened precisely at predetermined points. For example, inadequate precision in the recesses for fastening purposes, for seals in the case of clamping strips, may have an adverse effect on the sealing properties of the strip. This problem occurs in particular for strips which have a complex shape (first and second curvatures) and a U-shaped cross section with a narrow opening width (for example under 6 mm) at a strip length of 20 cm or more. The method makes it possible to provide the recesses at any time, for example before the U-shaped cross section is formed in the flat blank. This makes it possible to simplify the provision of the blanks in terms of process technology.

In a further aspect, the first length may be between 20 cm and 5 m, preferably between 30 cm and 2.5 m, preferably between 40 cm and 1 m, preferably between 50 cm and 90 cm and particularly preferably between 60 cm and 80 cm. The method is particularly suitable for long profiles. Parts of this type are particularly difficult to manufacture if they also have a complex geometry (narrow opening width of the cross section, a plurality of curvatures).

In a further aspect, the web material may comprise a metal. The metal may comprise an iron alloy, preferably a special steel. Although the processing of other materials is conceivable with the method, the method is particularly suitable for processing metals.

In a further aspect, the U-shaped cross section may have first and second limbs which extend in the longitudinal direction of the strip and thus form first and second side surfaces.

In a further aspect, the limbs are substantially parallel. However, the limbs may also converge with each other.

In a further aspect, the limbs meet at an apex point of the U-shaped profile.

In a further aspect, the limbs may be connected by an apex element.

In a further aspect, the apex element may be curved.

In a further aspect, the apex element may have a plurality of curvatures. With the method, a great multiplicity of different U-shaped cross sections can be produced. The term U shape is therefore not limited to a cross section with two parallel limbs and a curved apex element. On the contrary, all cross sections which completely enclose an area substantially by three sides and at most partially enclose said area by the fourth side such that an opening is formed are referred to as U-shaped. The enclosing limb and apex elements may in this case be arbitrarily shaped.

In a further aspect, the strip may contain two or more projections.

In a further aspect, the strip may contain four or more projections.

In a further aspect, the projections may be arranged on the same side of the U-shaped profile.

In a further aspect, the projections may have a V shape. Projections in a V shape may be particularly advantageous in order to clamp an element inserted into the U-shaped cross section. However, this function may also be met by projections having different shapes.

In a further aspect, the projections may be configured in order to clamp an element inserted into the volume.

In a further aspect, the blank may have a curved side. By the partial or complete cutting free or punching out of a curved blank from the web material, it can be ensured that the two limbs of the U-shaped cross section have a uniform height along the longitudinal direction of the strip when the latter has a curved shape.

In a further aspect, the strip may extend in the first curvature over 50% of the length of the strip in the longitudinal direction, preferably over 80% of the length of the strip in the longitudinal direction and particularly preferably substantially over the entire length of the strip in the longitudinal direction.

In a further aspect, the radius of curvature of the first curvature can lie between 200 mm and 50 000 mm, preferably between 1000 mm and 40 000 mm, preferably between 3000 mm and 30 000 mm.

In a further aspect, the radius of curvature of the first curvature at a first location along the longitudinal direction of the strip may be larger than at a second location along the strip.

In a further aspect, the radius of curvature of the first curvature may vary in a first region along the length of the strip.

In a further aspect, the radius of curvature of the first curvature may increase in the first region along the length of the strip.

In a further aspect, the radius of curvature of the first curvature may increase in the first region along the length of the strip from below 7000 mm to more than 10 000 mm, preferably from below 5000 mm to more than 15 000 mm.

The method is suitable in particular for producing strips with variable radii of curvature. Said strips can be formed with a single bending step and subsequent calibration.

In a further aspect, the blank may have a second curved side which is located opposite the first curved side.

In a further aspect, the embossing or deforming step in order to form the second curvature may comprise successively increasing a radius of curvature of the second curvature in a plurality of embossing or deforming steps.

In a further aspect, the embossing or deforming steps of the second curvature can be carried out in an alternating manner with embossing or deforming steps of the U-shaped cross section.

In a further aspect, the final embossing or deforming step of the second curvature may be carried out before the first embossing or deforming step of the U-shaped cross section.

In a further aspect, the final embossing or deforming step of the U-shaped cross section may be carried out before the first embossing or deforming step of the second curvature.

In a further aspect, the strip may extend in the second curvature over 50% of the length of the strip in the longitudinal direction, preferably over 80% of the length of the strip in the longitudinal direction and particularly preferably substantially over the entire length of the strip in the longitudinal direction.

In a further aspect, the radius of curvature of the second curvature may lie between 100 mm and 30 000 mm, preferably between 500 mm and 20 000 mm, preferably between 1000 mm and 10 000 mm.

In a further aspect, the radius of curvature of the second curvature at a third location along the longitudinal direction of the strip may be larger than at a fourth location along the strip.

In a further aspect, the radius of curvature of the first curvature may vary in a second region along the length of the strip.

In a further aspect, the radius of curvature of the first curvature may increase in the second region along the length of the strip.

In a further aspect, the radius of curvature of the second curvature may increase in the second region along the length of the strip from below 4000 mm to more than 5000 mm, preferably from below 3000 mm to more than 6000 mm.

In a further aspect, the distance of a tip of the one or more projections from an inner side of an opposite limb of the U-shaped cross section may be less than 10 mm, preferably less than 5 mm and particularly preferably less than 3 mm.

In a further aspect, the distance may be less than 1 mm. The clear width of the U-shaped cross section (of, for example 6 mm) is therefore further reduced by the projections projecting into the volume which is delimited by the U-shaped cross section and the longitudinal extent of the strip. The production of profiles with such a small clear width over a certain length (for example over 20 cm) is possible in a particularly efficient manner by the method.

In a further aspect, the embossing or deforming of the blank in order to form the U-shaped cross section can be carried out in four or more steps.

In a further aspect, the embossing or deforming of the blank in order to form the U-shaped cross section can be carried out in at least 5 and up to 20 steps, preferably in at least 8 and up to 15 steps.

In a further aspect, the wavy shape may comprise two or more wave troughs.

In a further aspect, the wavy shape may extend in the longitudinal direction over the entire length of the strip.

In a further aspect, the final embossing or deforming step in order to form the wavy shape may take place before the first embossing or deforming step in order to form the U-shaped cross section. The accuracy in the positioning of the wavy shape can be increased if the wavy shape is embossed before further deforming steps in order to form the U-shaped cross section (or optional first and second curvatures).

In a further aspect, the final embossing or deforming step of the one or more projections may take place before the first embossing or deforming step in order to form the U-shaped cross section.

In a further aspect, the opening in the U-shaped cross section may point downwards or upwards during the embossing or deforming steps of the method.

In a further aspect, the recesses may be arranged in pairs on opposite sides of the U-shaped cross section.

In a further aspect, at least one first recess of the at least two recesses may interrupt an edge which is formed by the U-shaped cross section and the longitudinal extent of the strip, wherein the first recess is formed in a first cutting-free or punching-out step.

In a further aspect, a second recess of the at least two recesses, which lies opposite the first recess, may be in the shape of a hole, wherein the second recess is formed in a second cutting-free or punching-out step.

In a further aspect, the first cutting-free or punching-out step may be carried out before the second cutting-free or punching-out step.

In a further aspect, the first cutting-free or punching-out step may be carried out at the same time as the second cutting-free or punching-out step.

In a further aspect, the cutting-free or punching-out step of the recesses from the web material may be carried out before the first embossing or deforming step in order to form the U-shaped cross section.

In a further aspect, one or more first recesses which are arranged on a first side of the U-shaped cross section may be formed in a first cutting-free or punching step, and one or more second recesses which are arranged on a second side opposite the first side of the U-shaped cross section may be formed in a second cutting-free or punching step which takes place after the first cutting-free or punching step.

In a further aspect, one or more first recesses which are arranged on a first side of the U-shaped cross section may be formed in a first cutting-free or punching step, and one or more second recesses which are arranged on a second side opposite the first side of the U-shaped cross section may be formed in a second cutting-free or punching step which takes place at the same time as the first cutting-free or punching step.

In a further aspect, the recesses may be arranged substantially equidistantly along the length of the strip.

In a further aspect, the recesses can be configured to receive a fastening element for fastening the strip.

In a further aspect, the depth of the U-shaped cross section may be successively increased in a plurality of deforming steps.

In a further aspect, an angle of inclination in which the sides of the U-shaped cross section are inclined with respect to one another may be successively reduced in a plurality of deforming steps.

In a further aspect, an embossing or deforming step in order to form the first curvature and an embossing or deforming step in order to form the second curvature may be carried out at the same time.

In a further aspect, an embossing or deforming step in order to form the U-shaped cross section may be carried out at the same time as the one embossing or deforming step in order to form the first and second curvatures.

In a further aspect, the blank may be connected on one or two opposite sides to transport tapes up to the separating operation.

In a further aspect, the blank may be connected on two opposite sides to respective transport tapes, and the method may furthermore comprise bending a holding web which connects the two transport strips. In the event of production of relatively long strips, in particular from thin web material (for example sheet metal with a thickness of 0.5 mm or less), the blanks which are secured at the transport tapes may have an undesirable bending. In the event of a strip which extends beyond a predetermined length in the longitudinal direction (for example more than 20 cm), the thin web material may therefore be bent. With the provision of additional holding webs which optionally have shaped embossing, the ensemble of the strips secured by the transport tapes can be stiffened. This can further increase the precision of the production process.

In a further aspect, the holding web may have shaped embossing.

In a further aspect, the method may comprise severing the holding web from the transport tapes.

In a further aspect, severing the holding webs can be carried out before the blank is calibrated.

In a further aspect, the method may comprise the following steps: partially or completely cutting free or punching out a blank from the web material in one or more steps, cutting free or punching out the recesses from the blank, and embossing or deforming the one or more projections in the blank in one or more steps, bending a holding web which is connected to two transport tapes on two opposite sides with respective transport tapes, embossing or deforming the blank in one or more steps in order to form a wavy shape on one of the sides of the U-shaped cross section, embossing or deforming the blank in order to form the U-shaped cross section at the same time as bending the blank in order to form first and second curvatures in which the strip extends in the longitudinal direction, severing the holding web from the transport tapes, calibrating the bent blank in order to form the U-shaped cross section at the same time as calibrating the blank in order to form the first and second curvatures, and separating the blank.

In a further aspect, the thickness of the web material is 1 mm or less, 0.8 mm or less, preferably 0.6 mm or less and particularly preferably 0.4 mm or less.

In a further aspect, the projections may have a length of 2 cm or less in the longitudinal direction, preferably a length of 1 cm or less in the longitudinal direction and particularly preferably a length of 0.5 cm or less in the longitudinal direction.

In a further aspect, the projections may project into the volume by 0.3 mm to 3 cm, preferably by 1 mm to 2 cm and particularly preferably by 2 mm to 1 cm.

In a further aspect, the projections may have a height of 2 cm or less, preferably 1 cm or less and particularly preferably 0.5 cm or less.

In a further aspect, the U-shaped cross section may have a height of 5 cm or less, preferably 3 cm or less and particularly preferably 2 cm or less.

In a further aspect, the U-shaped cross section may have a height of 1 cm or less.

In a further aspect, the U-shaped cross section may have a width of 3 cm or less, preferably 2 cm or less and particularly preferably 1 cm or less.

In a further aspect, the U-shaped cross section may have a width of 0.5 cm or less.

In a further aspect, the U-shaped cross section may have an opening width of 3 cm or less, preferably an opening width of 2 cm or less, preferably an opening width of 1 cm or less and particularly preferably an opening width of 0.6 cm or less.

The method is particularly advantageous for producing a strip which has an opening width of 6 mm or less, a length of 20 cm or more, and first and second curvatures with a first radius of curvature of between 3000 mm and 30 000 mm and a second radius of curvature of between 1000 mm and 10 000 mm.

A method for producing a strip from a web material using a follow-on and/or transfer method, wherein the strip to be produced has a first length of 20 cm or more in the longitudinal direction, has a U-shaped cross section, wherein the U-shaped cross section has an opening width of 6 mm or less and extends in the longitudinal direction in a first curvature and a second curvature, wherein the centre point of the first curvature lies to the side of a limb of the U-shaped cross section, and the centre point of the second curvature lies above or below an opening in the U-shaped cross section, wherein the method comprises the following steps:

- partially or completely cutting free or punching out a blank from the web material;
- embossing or deforming the blank in one or more steps so that the first curvature is formed;
- embossing or deforming the blank in one or more steps so that the second curvature is formed;
- embossing or deforming the blank in one or more steps so that the U-shaped cross section is formed.

A method for producing a strip from a web material using a follow-on and/or transfer method, wherein the strip to be produced has a first length in the longitudinal direction, a U-shaped cross section and at least two recesses which are arranged opposite one another on sides of the U-shaped cross section, wherein the method comprises the following steps:

- partially or completely cutting free or punching out a blank from the web material;
- cutting free or punching out the recesses from the web material;
- embossing or deforming the blank so that the U-shaped cross section is formed, wherein the step of cutting free the recesses is carried out before the U-shaped cross section is formed.

DETAILED DESCRIPTION

Figure 1A:
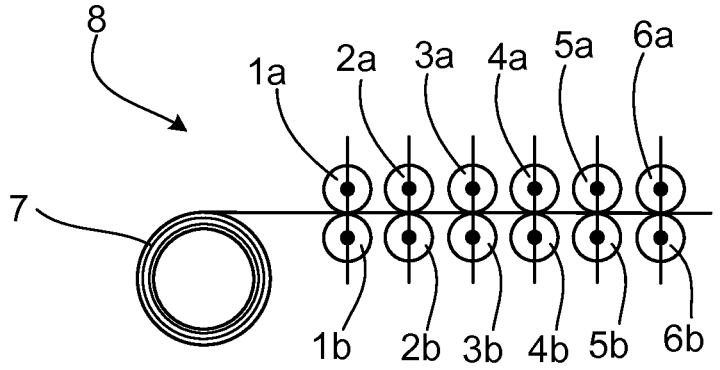
FIG. 1*a* shows a schematic illustration of a conventional rolling and bending method.
Figure 1B:
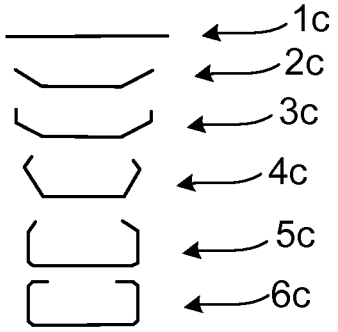
FIG. 1*b* shows a cross section of the starting, intermediate and final shapes of a profile which is manufactured by the rolling and bending method from FIG. 1*a*.
Figure 1C:
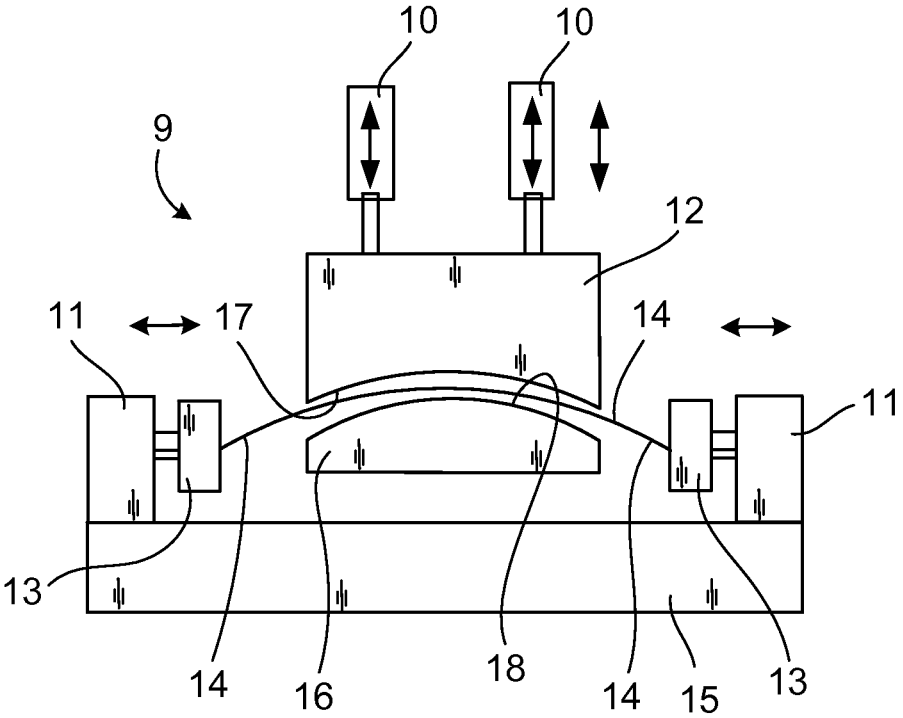
FIG. 1*c* shows a schematic illustration of a conventional stretching and bending method.
Figure 2A:
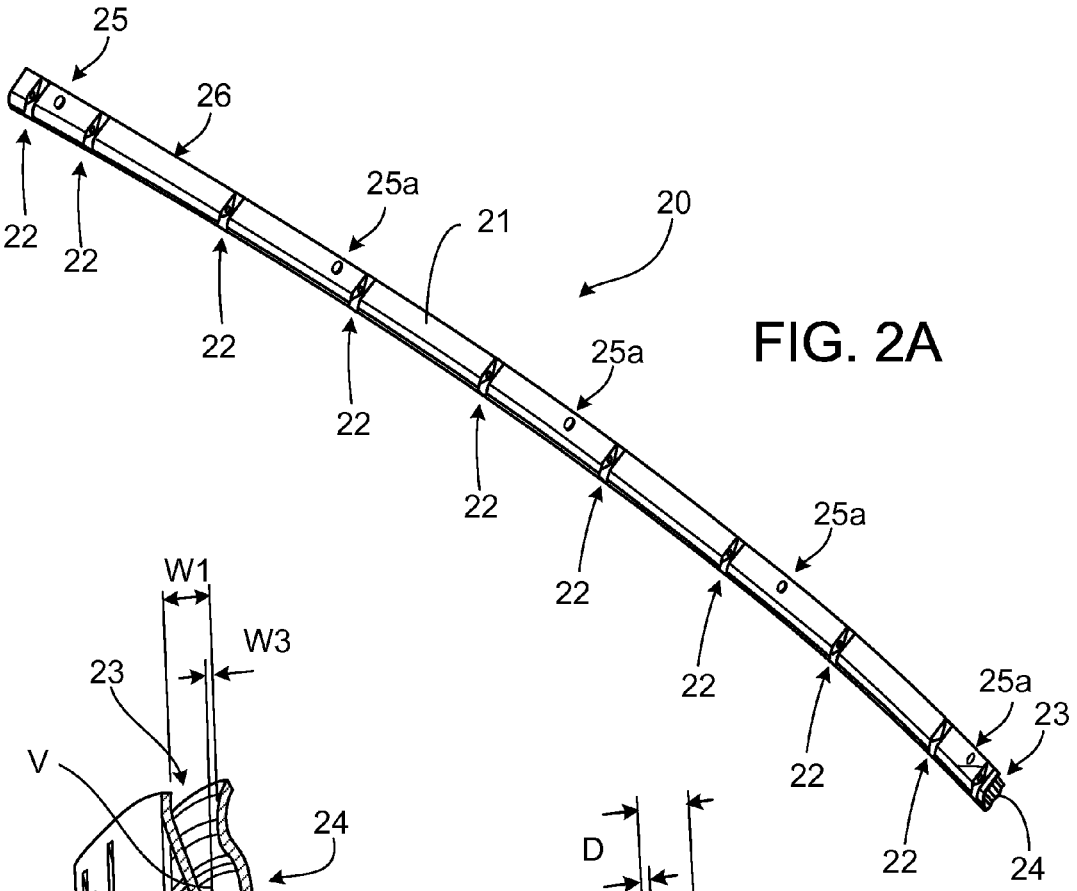
FIG. 2*a* shows a perspective illustration of a clamping strip.

FIGS. 2*a*, 2*b*, 2*c*, 3*a*, 3*b* and 3*c* illustrate various views and details of an exemplary clamping strip 20 as can be produced by a follow-on or transfer method. As shown in FIG. 2*a*, the strip 20 extends along a longitudinal direction. In addition, the strip has a U-shaped cross section 23, and therefore a volume V is delimited by said U-shaped cross section 23 and the longitudinal extent of the strip. One or more projections 22 project into said volume V. In the strip shown in FIG. 2*a*, the projections 22 form clamping cams which are configured for clamping an element inserted into the volume V. In the exemplary clamping strip 20, ten projections 22 have been provided on a side surface of the strip 20. However, the method is not limited to a certain number or geometry of the projections 22. It is thus equally possible for projections 22 to be arranged on both side surfaces. In addition to the projections 22, further features may also be provided in the strip 20 by the methods. The strip 20 illustrated in FIG. 2*a* contains perforations 25*a* which can serve for fastening the strip.

Figure 2B:
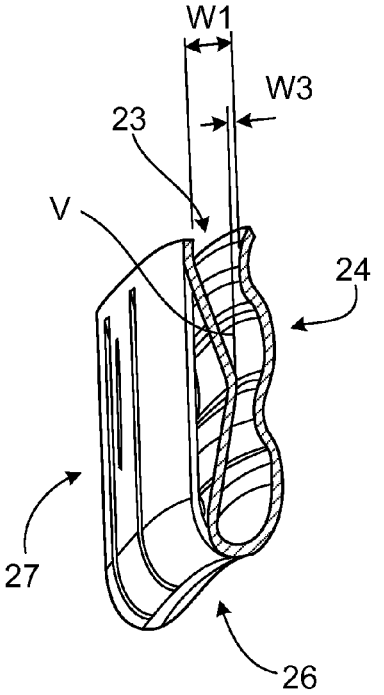
FIG. 2*b* shows a perspective illustration of a detail of the clamping strip from FIG. 2*a*.

FIG. 2*b* shows a perspective illustration of a detail of the clamping strip from FIG. 2*a*. In this view, part of the volume V of the strip 20 is illustrated. The projections 22 are configured as discrete V-shaped structures which project into the volume V. As can be seen in FIG. 2*b*, the projections 22 therefore reduce the clear width of the U-shaped cross section 23 to a minimum width W3. Typically, an opening width W1 of the U-shaped cross section 23 already lies below 1 cm, preferably below 6 mm. The minimum width W3 of the U-shaped cross section can therefore be less than 2 mm or even less than 1 mm. In addition to the projections 22, a wavy shape 24 can be seen in FIG. 2*b*, said wavy shape having been embossed on a side surface of the strip 20 opposite the side surfaces with the projections 22. The wavy shape 24 is adapted in order, together with the projections 22, to clamp an element inserted into the volume V. In contrast to the projections 22, the wavy shape 24 extends substantially over the entire length of the strip 20. The follow-on or transfer methods have a high degree of flexibility as far as the structures provided in the side surfaces of the strip are concerned. The shape and size of said features can therefore be adapted according to the requirements of the part to be produced.

In addition to the features on the side surfaces of the strip 22, it can be seen in FIG. 2*b* that the strip extends in a first curvature 27 and a second curvature 26 in the longitudinal direction. The centre point of the first curvature 27 lies to the side of a limb of the U-shaped cross section 23 and the centre point of the second curvature 26 lies above or below an opening in the U-shaped cross section 23. The strip 20 therefore extends in a three-dimensional curvature (i.e. not in a single plane) in the longitudinal direction.

Figure 2C:
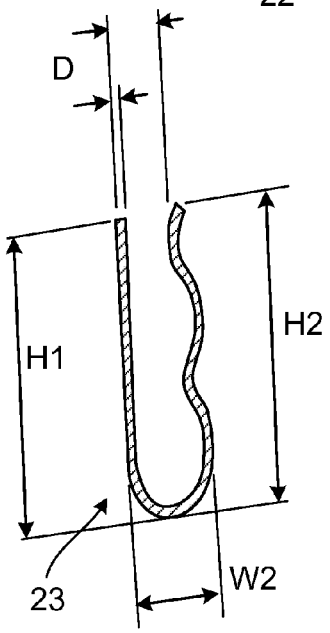
FIG. 2*c* shows an illustration of a cross section of the clamping strip from FIG. 2*a*.

The U-shaped cross section 23 is illustrated in detail in FIG. 2*c*. In the present case, the cross section is defined by two substantially parallel limbs and an apex element which connects the latter. The U-shaped cross section 23 has two heights H1, H2, which do not necessarily have to be identical, and a width W2. As can be seen in FIG. 2*c*, the width may vary along the limbs of the U-shaped profile 23.

The methods are particularly suitable for processing sheets. It can be seen in FIG. 2*c* that a sheet of the thickness D has been processed. The methods are suitable for processing relatively thin sheets (for example thinner than 0.5 mm).

Figure 3A:
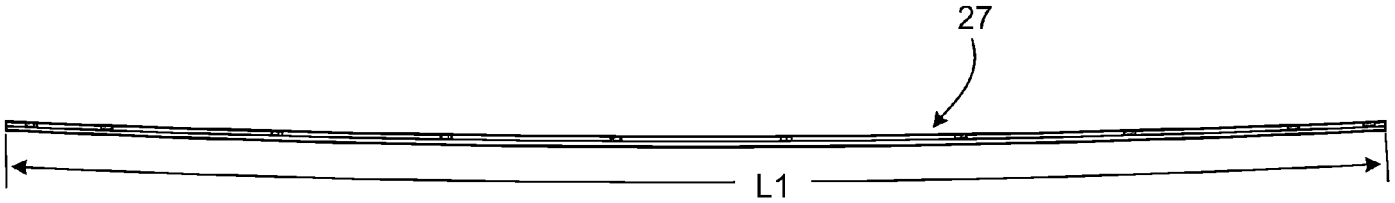
FIG. 3*a* shows a view of a clamping strip.
Figure 3B:
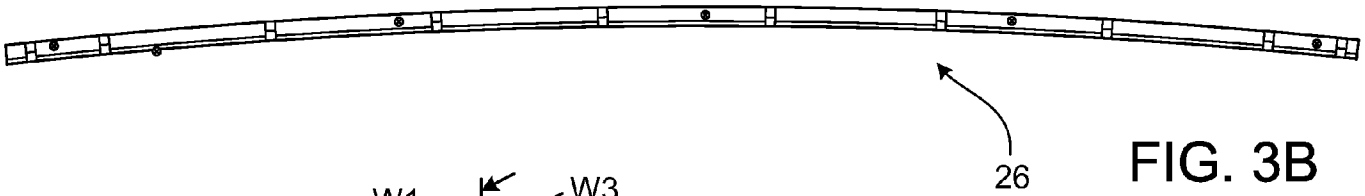
FIG. 3*b* shows a further view of the clamping strip from FIG. 3*a*.
Figure 3C:
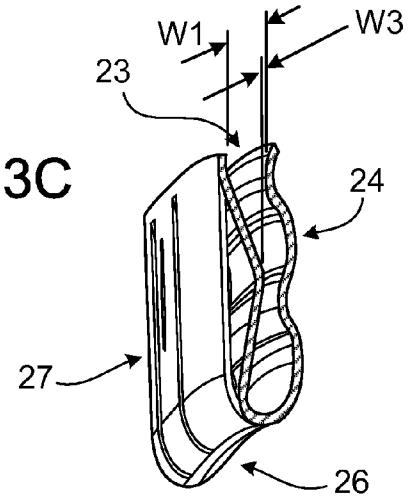
FIG. 3*c* shows an illustration of a detail of the clamping strip from FIG. 3*a*.

FIG. 3*a* and FIG. 3*b* show two views of the clamping strip from FIG. 2*a*. In these figures, the first curvature 27 and second curvature 26 can clearly be seen. Since FIG. 3*a* constitutes a plan view of the strip 20 and FIG. 3*b* constitutes a view of said strip 20 rotated through 90° with respect thereto, it is clearly apparent looking at said two figures that the strip 20 extends in two curvatures which together produce a three-dimensional curvature of the strip 20. Furthermore, the length L1 of the strip in the longitudinal direction is shown in FIG. 3*a*. In this case, the length L1 is measured along the curvature of the strip and not as a distance between the two end points of the strip. The method is particularly suitable for producing long strips (preferably longer than 20 cm or longer than 50 cm). FIG. 3*c* shows a detail of the strip 20 along a sectional plane A-A and FIG. 3*b* shows a detail in a perspective view. As already explained in conjunction with FIG. 2*b*, the projections and the opposite wavy shape 24 are visible.

Figure 4A:
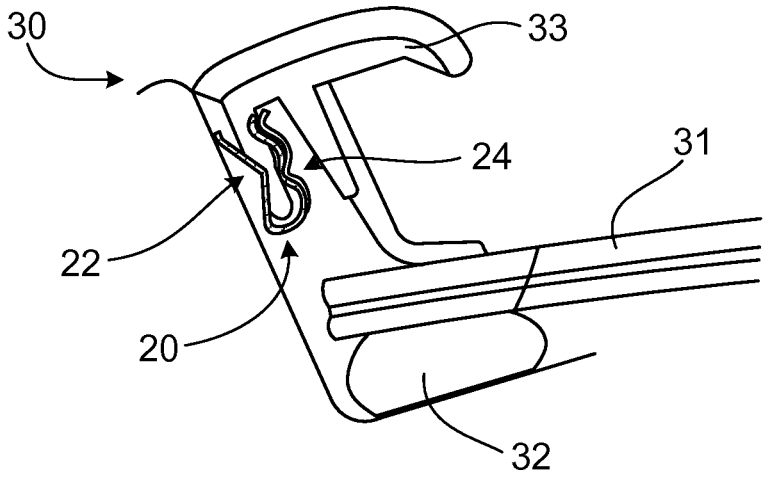
FIG. 4*a* shows a sectional drawing of a fitted clamping strip.
Figure 4B:
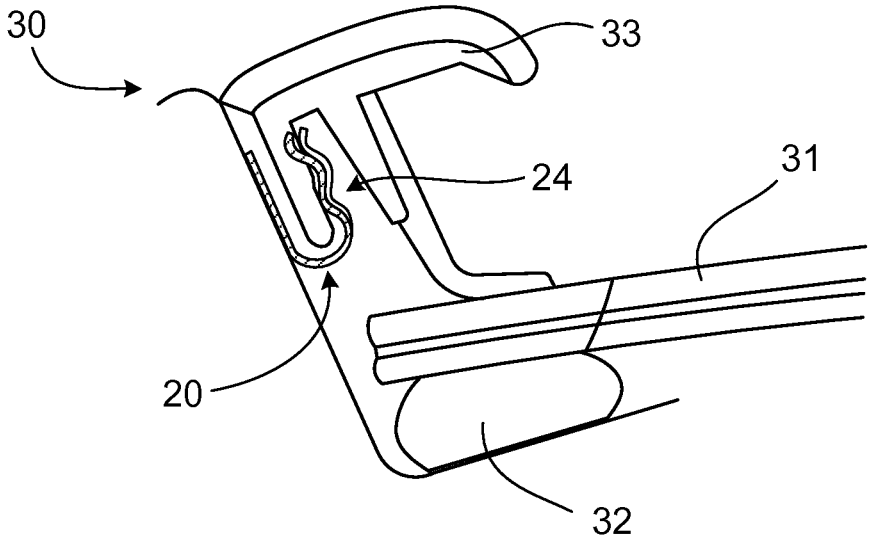
FIG. 4*b* shows a further sectional drawing of a fitted clamping strip.

FIGS. 4*a* and 4*b* show the clamping strip 20 from FIG. 3*a* in a typical application. A window pane 31 is attached to a side frame 30 of a vehicle body with the aid of an adhesive 32. With the use of the clamping strip 20 produced by the method, a combined plastics/rubber element (2-component element) 33 is connected to the side frame 30, ensuring sealing of the gap between the side frame 30 and window pane 31. FIGS. 3*a* and 3*b* show the fitted clamping strip 20 in different sectional planes along the longitudinal direction of the strip 20 in order to clarify the interaction of the projections 22 and the wavy shape 24 during clamping.

Figure 5:
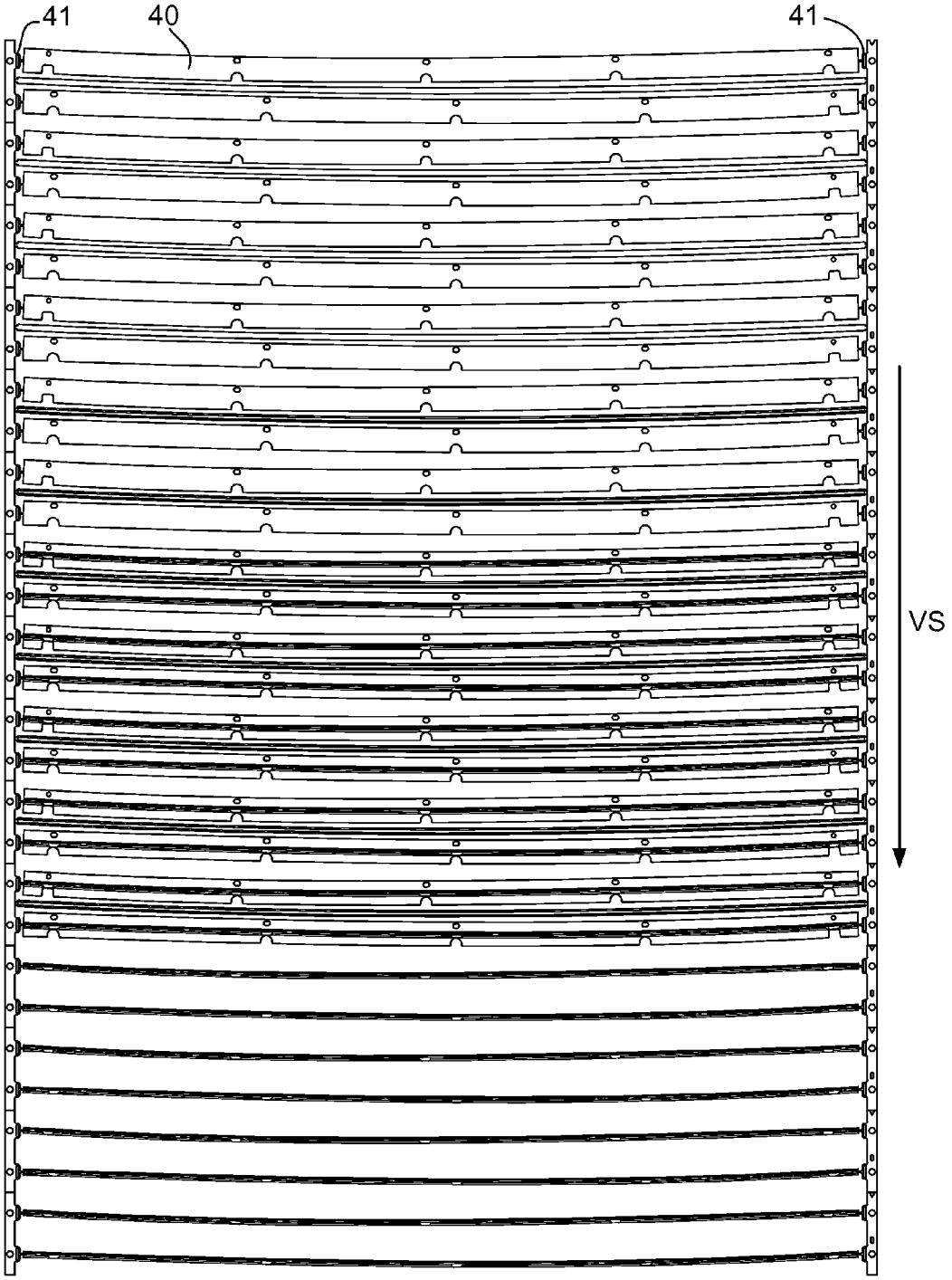
FIG. 5 shows a method plan for a follow-on method.

FIG. 5 illustrates an exemplary method plan of a follow-on method. At two lateral transport tapes 41 there are blanks 40 which are processed by the method to form a clamping strip 20, as shown in FIGS. 3 and 4. Two blanks 40 are processed by the respective method step at each method station. The assembly of the blanks 40 and transport tapes 41 is subsequently advanced by a predetermined length to the next station. FIG. 5 indicates the direction of advance VS of the follow-on process. The method is customarily clocked and all of the method steps are carried out once per clock pulse. Two clamping strips 20 are therefore produced per clock pulse of the method.

Figure 6A:
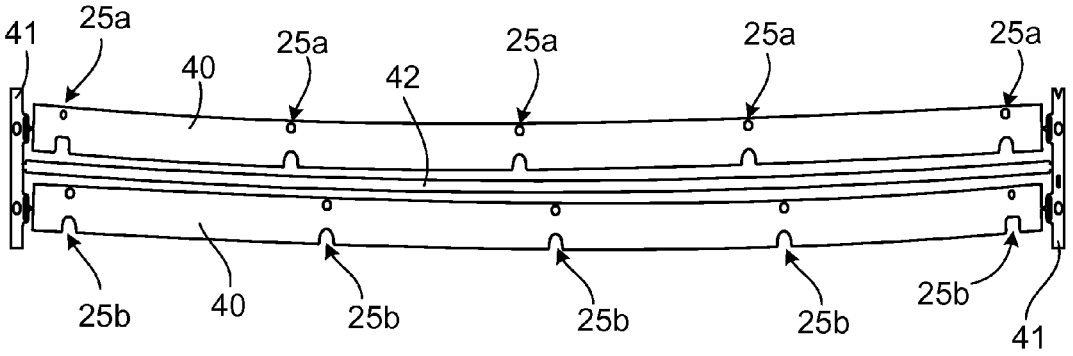
FIG. 6*a* shows a further detail from the method plan of a follow-on method from FIG. 5.

FIGS. 6 and 7 show some of the stations of the follow-on method from FIG. 5 in detail. First of all a web material is supplied to the method (not shown in the figure). This preferably involves sheet metal which is supplied from a coil. FIG. 6*a* shows two blanks which have been partially or completely cut free or punched out from the web material. Said steps are preferably carried out before a U-shaped cross section and/or first and second curvatures are embossed or bent into the blank. The provision of the recesses in a blank with a U profile, in particular in a blank with a narrow opening width of less than 6 mm, may be complicated in terms of process technology. In the example of FIG. 6*a*, the blanks are cut free or punched out with curved sides along the longitudinal direction (although the longitudinal direction of the blank 40 does not have to coincide with the longitudinal direction of the strip because of the curvature of the finished strip 20, the two directions nevertheless approximately correspond with moderate curvatures). A uniform height of the side surfaces of the strip is therefore ensured. In the first steps (for example in the first four steps), further features of the strip 20 may also be provided in the blank 40. Recesses 25*a*, 25*b* may thus be provided in the blank. The example shown in FIG. 6*a* involves structures opposite one another in pairs, in each case a perforation 25*a* and a corresponding structure 25*b* provided in the edge of the blank. In the finished strip 20, said recesses 25*a*, 25*b* serve for fastening the strip, wherein a fastening element (for example a rivet or screw) is guided through the recesses.

In addition to the features of the blank, auxiliary structures may also be cut free or punched out in the first stations of the exemplary method. For example, the transport tapes 41 may thus be formed from the web material. In addition, structures ensuring the structural integrity of the assembly of the support tapes 41 and blanks 40 may be cut free or punched out. In particular in the case of the production of relatively long strips 20 (for example longer than 20 cm) in thin sheet (thinner than 1 mm), the material to be processed may sag or be distorted. This can be counteracted by cutting free or punching out a holding web 42. In the example from FIG. 5, a holding web 42 is formed between two blanks 40 in each case. However, it is also conceivable for a plurality of holding webs and/or holding structures having a different geometry to be formed.

Figure 6B:
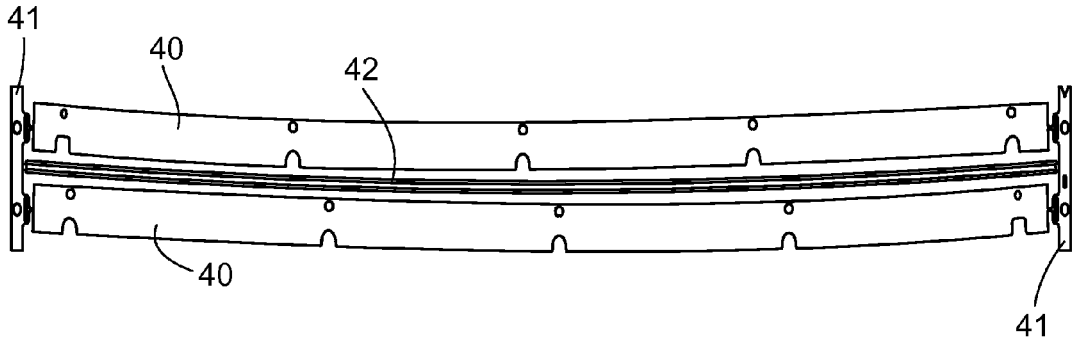
FIG. 6*b* shows a further detail from the method plan of a follow-on method from FIG. 5.
Figure 6C:
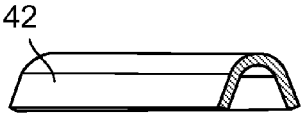
FIG. 6*c* shows a perspective illustration of a detail of a holding web.

FIG. 6*b* shows a further optional step for increasing the structural integrity of the assembly of support tapes 41 and blanks 40. By a shaped profile (see, for example, the V-shaped profile shown in FIG. 6*c*) being embossed into the holding web 42, the resistance thereof to sagging or distortion can be improved even further. The geometry of the shaped profile can be selected in accordance with the desired mechanical properties of the holding web 42. The embossing of the holding web into the planar web material makes it possible to realize a multiplicity of different shaped profiles.

Figure 7A:
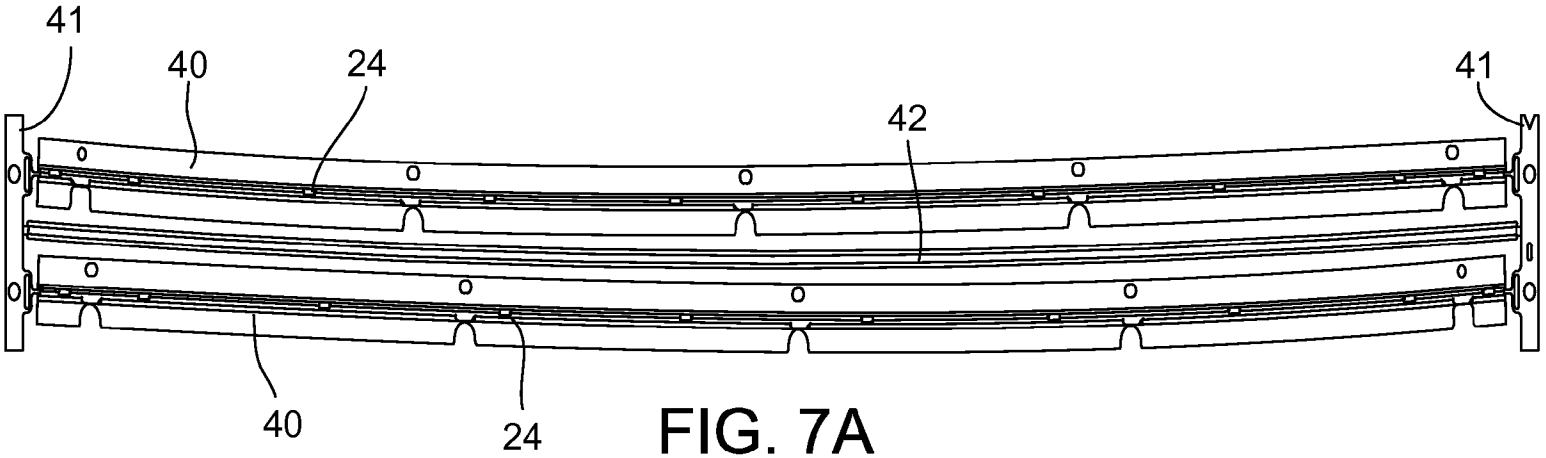
FIG. 7*a* shows a further detail from the method plan of a follow-on method from FIG. 5.

After the steps of cutting free or punching out the blank 40 and optionally further features, in a next step, which is illustrated in FIG. 7*a*, projections (not shown in FIG. 7*a*) and optionally a wavy shape 24 are formed in the blank 40 by embossing or deforming. At this time, the blank 40 is preferably still flat, which increases the precision in positioning the projections and optionally the wavy shape 24.

Figure 7B:
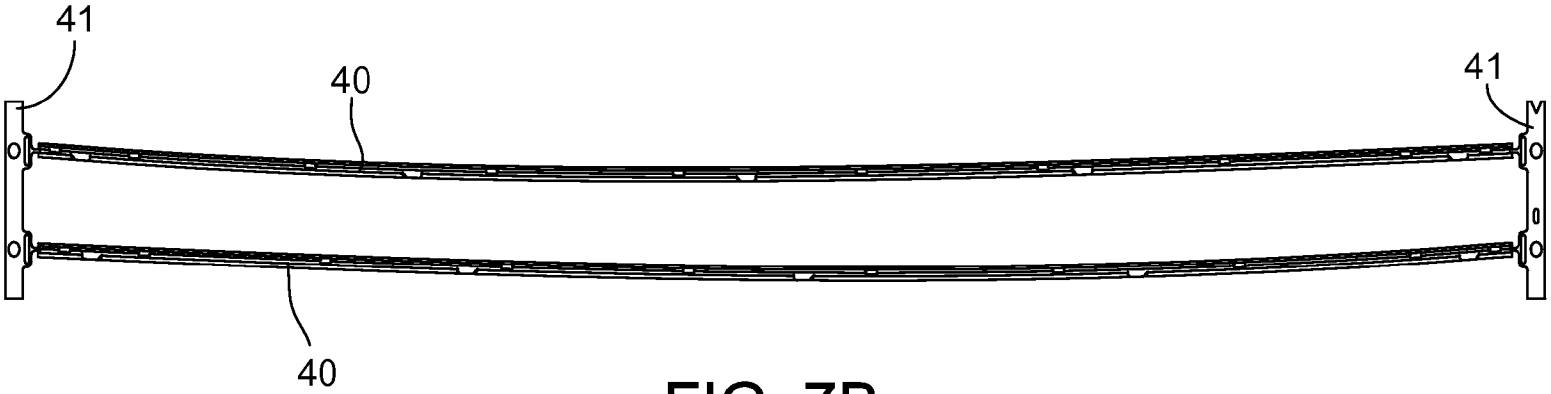
FIG. 7*b* shows a further detail from the method plan of a follow-on method from FIG. 5.

Following the embossing or deforming in order to form the projections and optionally the wavy shape 24, in a further step, as shown in FIG. 7*b*, the U-shaped cross section 23 is formed in the blank by embossing or deforming. In this step, the bending of the blank 40 in order to form the first curvature 27 and/or second curvature 26 may optionally also be carried out. The U-shaped cross section 23 and the first curvature 27 and the second curvature 26 are preferably bent in this step (this does not mean that the final geometry of the strip 20 with respect to the U-shaped profile 23 and the first curvature 27 and second curvature 26 is produced in this one step and further subsequent steps are possible in order to form said features). The follow-on method is suitable in particular for producing strips which have a U-shaped cross section 23 with a small opening width W1 (less than 6 mm) at a length L1 of 20 cm or more and at the same time have a first curvature 27 and a second curvature 26 in the longitudinal direction. Structures of this type can be produced only in a significantly more expensive manner in conventional methods.

In addition to the steps discussed in detail above, the method may also comprise further steps. The holding webs 42 are optionally severed, for example after the embossing or deforming of the U-shaped cross section 23. Furthermore, as the final method step of an exemplary follow-on method, the processed blanks 40 can be separated from the transport tapes 41. In a number of examples, all of the deforming steps in order to produce the strip 20 may proceed in a follow-on method.

Figure 13:
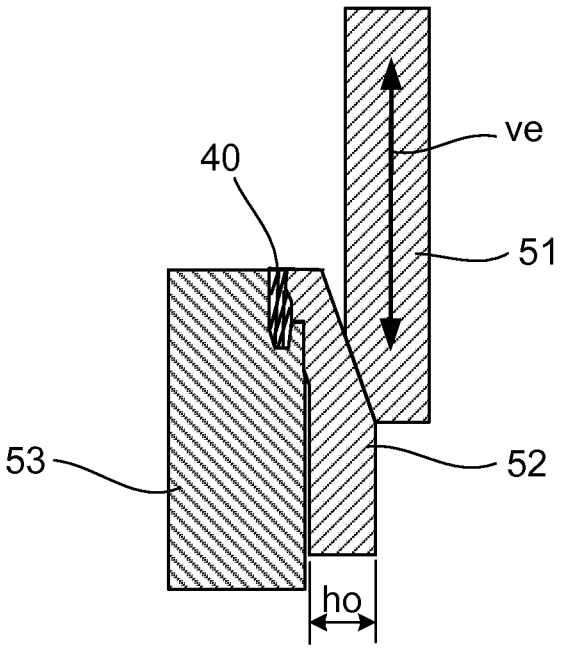
FIG. 13 shows a sectional view of a detail of a tool for use in a follow-on method.

It may furthermore be necessary or desirable to calibrate the U-shaped cross section 23 and optionally the first curvature 27 and second curvature 26 after the step of forming the first and second curvatures. A desired end shape of the strip 20 can thereby be obtained and any inaccuracies in the previous embossing, deforming and bending steps compensated for. As shown in FIG. 13, a calibrating step of this type may be carried out using a tapered slide. Whereas, in the previous processing steps, the tools customarily act on the blank in the vertical direction ve, the tapered slide 51, 52 is used to rotate the vertical movement through 90° and convert said movement into a movement in the horizontal direction ho. The blank 40 can therefore be brought into the final shape thereof between two shaping tools 52, 53.

FIGS. 8 to 13 show exemplary tools as can be used in a method. The tools shown serve to produce a strip of approx. 70 cm in length with a U-shaped profile and a three-dimensional curvature in the longitudinal direction and with projections and a wavy shape and recesses for fastening the strip, which are arranged on the side surfaces of the strip. However, the tools may also be modified such that it is possible to produce a strip which does not have one or more of the features just mentioned.

Figure 8A:
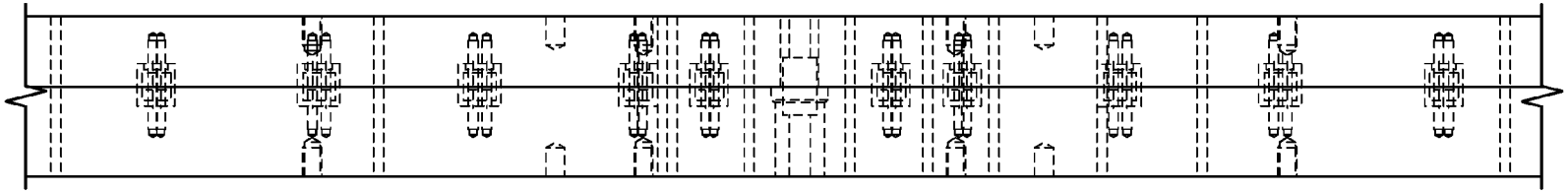
FIG. 8*a* shows a view from below of a tool for use in a follow-on method.
Figure 8B:
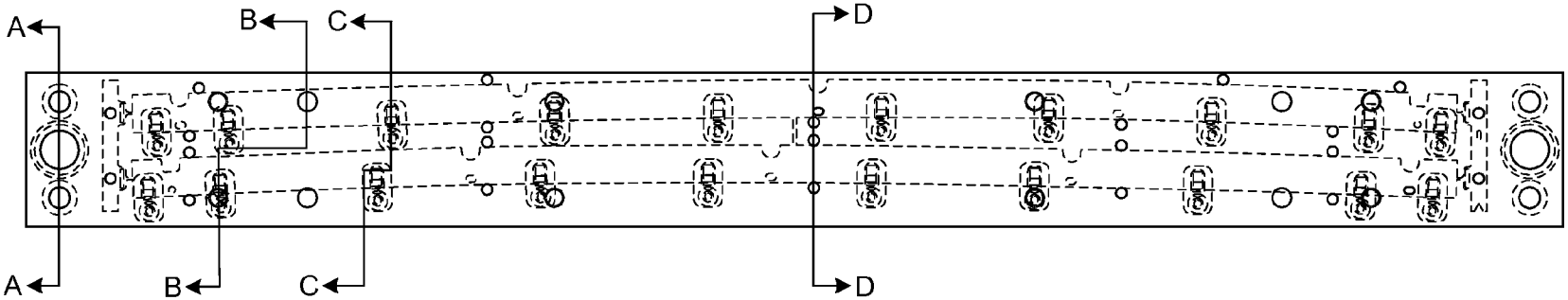
FIG. 8*b* shows a front view of the tool for use in a follow-on method from FIG. 8*a*.
Figure 9A:
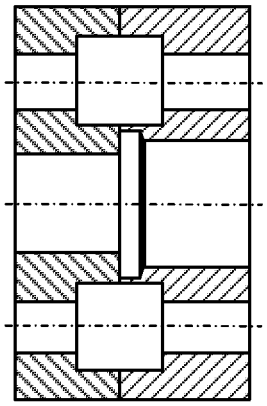
FIG. 9*a* shows a sectional drawing of the tool for use in a follow-on method from FIG. 8*a* along the section line A-A shown in FIG. 8*b*.
Figure 9B:
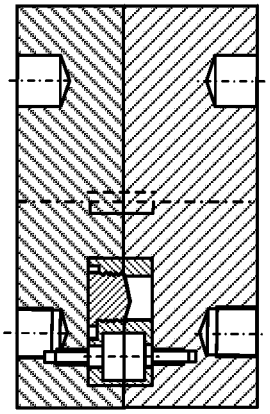
FIG. 9*b* shows a sectional drawing of the tool for use in a follow-on method from FIG. 8*a* along the section line B-B shown in FIG. 8*b*.
Figure 9C:
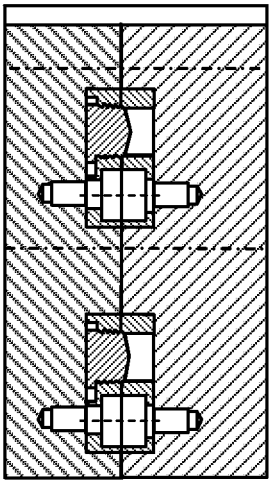
FIG. 9*c* shows a sectional drawing of the tool for use in a follow-on method from FIG. 8*a* along the section line C-C shown in FIG. 8*b*.
Figure 9D:
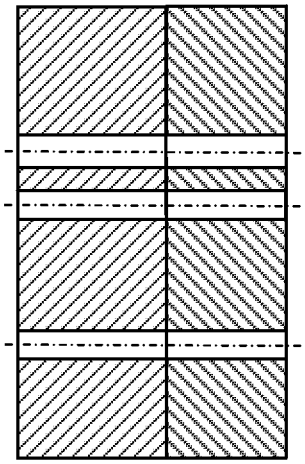
FIG. 9*d* shows a sectional drawing of the tool for use in a follow-on method from FIG. 8*a* along the section line D-D shown in FIG. 8*b*.

FIG. 8*a* and FIG. 8*b* illustrate a view from below of a tool for use in a follow-on method and a front view of the same tool, respectively. The exemplary tool contains ten groups of punching tools which are each adapted in order to punch a pair of recesses 25*a*, 25*b*. As can be seen in FIG. 8*b*, two blanks 40 are each provided with recesses 25*a*, 25*b* with the tool. In FIGS. 9*a*, 9*b*, 9*c* and 9*d*, various sections through the tools shown in FIGS. 8*a* and 8*b* along the planes identified in FIG. 8*b* can be seen. In particular, FIGS. 9*b* and 9*c* show sections through the punching tools for punching the recesses 25*a*, 25*b*.

Figure 10A:
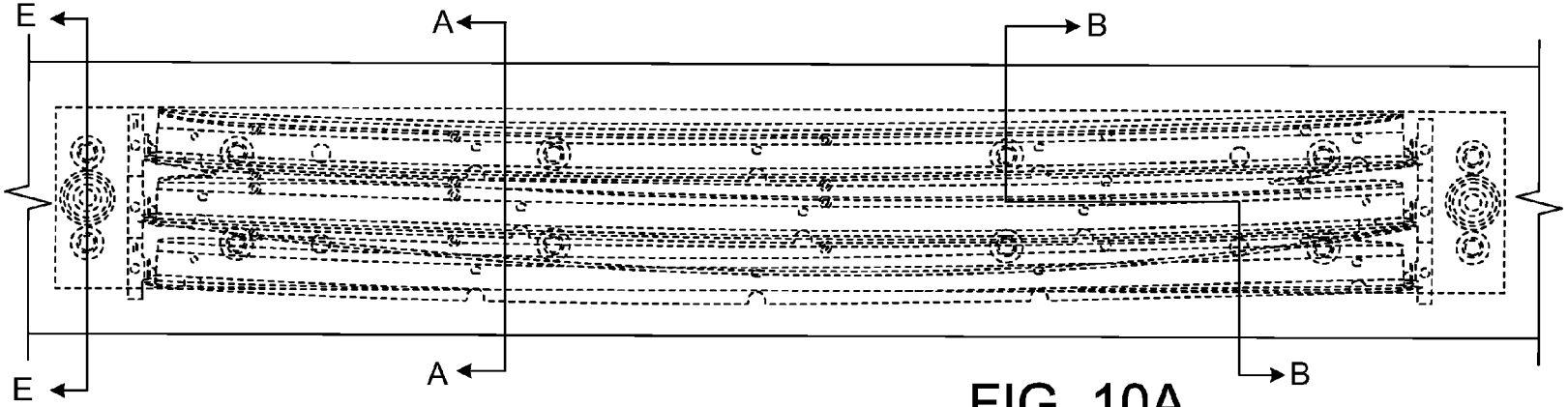
FIG. 10*a* shows a front view of a tool for use in a follow-on method.
Figure 10D:
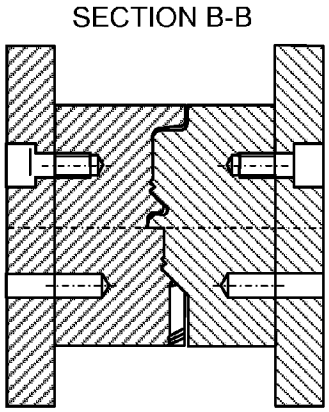
FIG. 10*d* shows a sectional drawing of the tool for use in a follow-on method from FIG. 10*a* along the section line B-B shown in FIG. 10*a*.
Figure 10C:
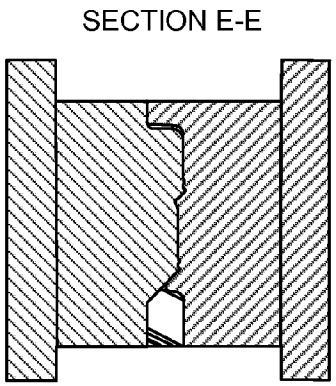
FIG. 10*c* shows a sectional drawing of the tool for use in a follow-on method from FIG. 10*a* along the section line E-E shown in FIG. 10*a*.
Figure 10B:
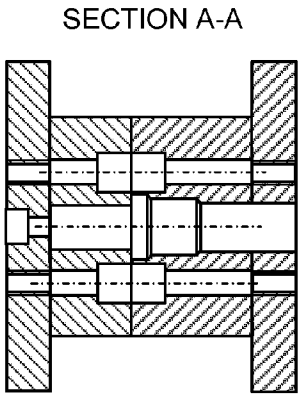
FIG. 10*b* shows a sectional drawing of the tool for use in a follow-on method from FIG. 10*a* along the section line A-A shown in FIG. 10*a*.

FIGS. 10*a*, 10*b*, 10*c* and 10*d* illustrate various illustrations of an embossing tool for forming the projections and the wavy shape. FIGS. 10*b*, 10*c* and 10*d* show sections along the planes identified in FIG. 10*a*. The projections and the wavy shape are embossed in a blank which is still substantially flat. As can be seen in FIG. 10*c* and FIG. 10*d*, complex structures may also be embossed in this manner with a simple punch and die pair.

Figure 11A:
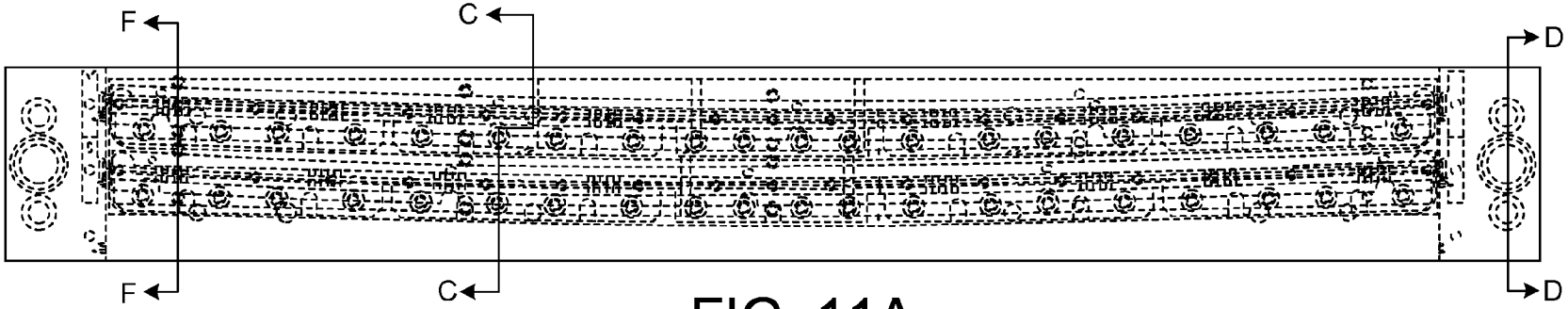
FIG. 11*a* shows a front view of a tool for use in a follow-on method.
Figure 11B:
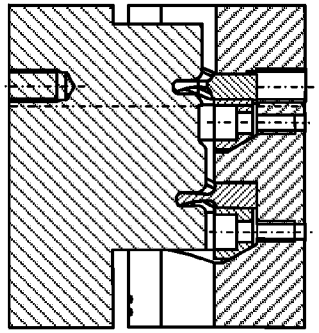
FIG. 11*b* shows a sectional drawing of the tool for use in a follow-on method from FIG. 11*a* along the section line C-C shown in FIG. 11*a*.
Figure 11C:
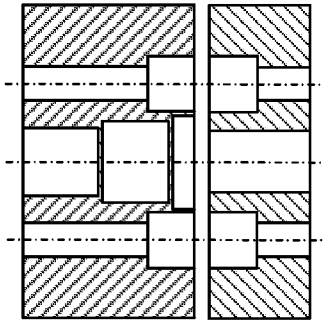
FIG. 11*c* shows a sectional drawing of the tool for use in a follow-on method from FIG. 8*a* along the section line D-D shown in FIG. 10*a*.
Figure 12:
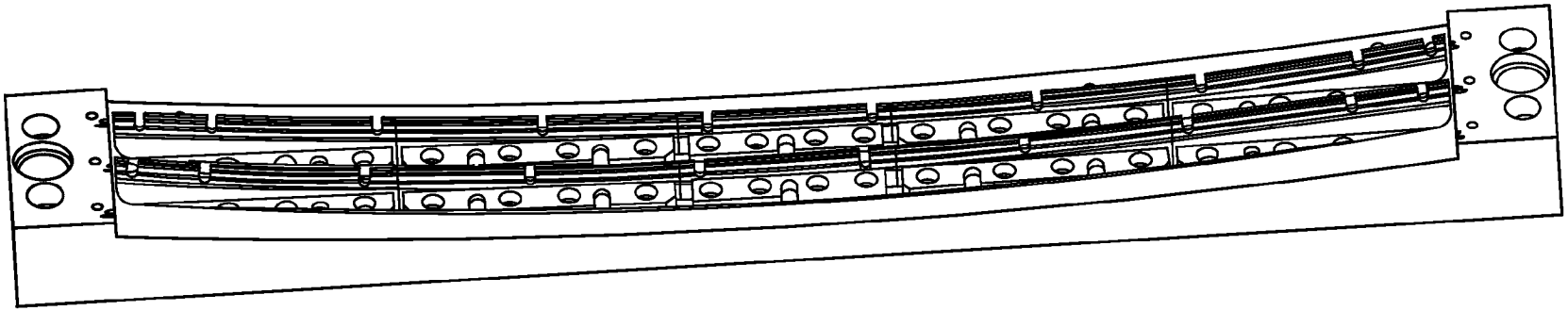
FIG. 12 shows an isometric view of a tool for use in a follow-on method from FIG. 11*a*.

FIGS. 11*a*, 11*b* and 11*c* contain various illustrations of an exemplary bending/embossing tool for forming the U-shaped cross section and the first and second curvatures. As can be seen in FIG. 11*b*, a correspondingly shaped web of the bending/embossing tool ensures the formation of the U-shaped profile. The first and second curvatures are produced by corresponding shaping of the punch and of the die of the bending/embossing tool. As can be seen in FIG. 12 in a perspective view of the bending/embossing tool from FIG. 11*a*, two blanks are also provided in parallel with the U-shaped cross section and the first and second curvatures in this method step. Furthermore, it can be seen that the web of the bending/embossing tool has interruptions at the location of the projections. It is thereby possible to carry out the step of embossing or deforming the U-shaped cross section after the projections are formed.

The invention claimed is:

1. Method for producing a curved, elongate strip from a web material using a follow-on and/or transfer method, wherein the curved, elongate strip to be produced:

has a first length of 20 cm or more in a longitudinal direction, the longitudinal direction being a direction of largest extent of the curved, elongate strip, has a U-shaped cross section in a plane perpendicular to the longitudinal direction of the curved, elongate strip, wherein the U-shaped cross section has an opening width of 6 mm or less and extends in the longitudinal direction in a first curvature having a first radius and a first center point of curvature and a second curvature having a second radius and a second center point of curvature different from the first center point of curvature, wherein the center point of the first curvature lies to the side of a limb of the U-shaped cross section and the center point of the second curvature lies above or below an opening in the U-shaped cross section, the method for producing the curved, elongate strip comprising:

partially or completely cutting free or punching out an elongate blank from the web material;

embossing or deforming the elongate blank in one or more steps so that the first curvature is formed;

embossing or deforming the elongate blank in one or more steps so that the second curvature is formed; and embossing or deforming the elongate blank in one or more steps so that the U-shaped cross section is formed in a plane perpendicular to a longitudinal direction of the elongate blank, the longitudinal direction being the direction of largest extent of the elongate blank.

2. Method according to claim 1, wherein the radius of curvature of the second curvature lies between 100 mm and 30 000 mm.

3. Method according to claim 1, wherein the radius of curvature of the first curvature lies between 200 mm and 50 000 mm.

4. Method according to claim 1, wherein embossing or deforming in order to form the first curvature comprises:

bending the elongate blank in one or more steps; and calibrating the bent elongate blank in one or more steps.

5. Method according to claim 1, wherein embossing or deforming in order to form the second curvature comprises:

bending the elongate blank in one or more steps; and calibrating the bent elongate blank in one or more steps.

6. Method according to claim 1, wherein at least one step of bending the elongate blank in order to form the first curvature and at least one step of bending the elongate blank in order to form the second curvature are carried out at the same time.

7. Method according to claim 1, wherein embossing or deforming the elongate blank in order to form the U-shaped cross section comprises:

bending the elongate blank in one or more steps;

calibrating the bent elongate blank in one or more steps.

8. Method according to claim 1, wherein, furthermore, at least one step of bending the elongate blank in order to form the U-shaped cross section and at least one step of bending the elongate blank in order to form the first curvature and the second curvature are carried out at the same time.

9. Method according to claim 1, wherein the elongate blank is connected on one or two opposite sides to transport tapes.

10. Method according to claim 9, wherein the elongate blank is connected on two opposite sides to respective transport tapes, and the method furthermore comprises:

bending a holding web which connects the two transport tapes.

11. Method according to claim 10, wherein the holding web has a shaped embossing.

* * * * *